United States Patent [19]

Briles

[11] 4,048,708

[45] Sept. 20, 1977

[54] RIVETING METHOD EXPANDING A WORK COUNTERBORE

[76] Inventor: Franklin S. Briles, 1301 Dolphin, Corona del Mar, Calif. 92625

[21] Appl. No.: 687,165

[22] Filed: May 17, 1976

[51] Int. Cl.[2] ..... B21D 39/00; B23P 11/00

[52] U.S. Cl. ..... 29/509; 29/522; 85/37

[58] Field of Search ..... 29/509, 522, 526; 85/37, 9 R; 52/758 D, 758 F

[56] References Cited

U.S. PATENT DOCUMENTS

| | | | |
|---|---|---|---|
| 2,482,391 | 9/1949 | Webster | 85/37 |
| 3,239,036 | 3/1966 | Scott | 52/758 F |
| 3,634,928 | 1/1972 | Falcioni | 29/522 X |
| 3,747,467 | 7/1973 | Rosman | 29/522 X |

FOREIGN PATENT DOCUMENTS

| | | | |
|---|---|---|---|
| 808,306 | 7/1951 | Germany | 85/37 |
| 694,368 | 7/1953 | United Kingdom | 85/37 |

*Primary Examiner*—Charlie T. Moon
*Attorney, Agent, or Firm*—William W. Haefliger

[57] ABSTRACT

The method of securing a rivet slug to structure containing a bore, a substantially cylindrical first counterbore that opens to one side of the work, and a second counterbore that tapers forwardly between the first counterbore and said bore, includes the steps:

a. inserting the slug to extend within the bore and counterbores, and b. deforming the slug axially and radially to fill the bore and counterbores and to expand the first counterbore.

10 Claims, 11 Drawing Figures

RIVETING METHOD EXPANDING A WORK COUNTERBORE

BACKGROUND OF THE INVENTION

This invention relates generally to riveting, and more particularly concerns improvements in riveting techniques involving expansion of a rivet slug to provide a fastened joint exhibiting high shear strength, high fatigue strength and sealing properties, and many other advantages.

Experience with conventional rivet retention of aircraft skins to fuselage structure has indicated several disadvantages and problems, particularly where fully tapered flush head rivets are employed. It has been found that when the structure including the skin or panel is flexed, the fully tapered hole (countersunk in the skin to receive the head) tends of elongate, i.e. becomes non-circular, producing a clearance between the rivet head and the tapered seat. As a result, corrosive fluids can and do enter the gap or clearance to corrode the connection over a period of time. Also, "fretting" of the skin material at the countersink frequently occurs, weakening the skin material so that fatigue cracks can and do occur more readily. Paint or other sealant applied over the rivet head and skin surface as a barrier tends to crack in response to flexing and to become ineffective to prevent ingress of corrosive fluid. Also, the paint enters the circular clearance about the rivet head end, to form an unsightly, visible ring. Another problem concerns the relatively large outer diameters of fully tapered conventional rivet heads, which undesirably limits the number of rivets that can be employed in or along a given area or dimension of skin material. A further problem had to do with the difficulty of maintaining a flush relationship of the rivet head and the work surface.

SUMMARY OF THE INVENTION

It is a major object of the invention to provide solutions to the above as well as other problems, through the provision of a simple riveting method incorporating a number of unusual advantages. Basically, these stem from the concept that the rivet is deformed to fit the hole in unusually advantageous manner, rather than the hole being formed to fit a rivet head as in the past. Other major objects are to create radial expansion and peripheral tension of the work to increase fatigue strength, and to reduce the size of the expanded rivet head relative to the shank diameter.

Typically, the workpiece or skin has a main bore, a first counterbore which advantageously is or may be substantially cylindrical, and a second counterbore which is frusto-conical to taper forwardly between the first counterbore and the main hole. The rivet itself typically has slug configuration that includes a shank defining an axis, a first radially expandable sealing section immediately forwardly of the end face, and a second section located between the first section and the shank. As will be seen, the first and second sections typically may have outer diameters somewhat larger than that of the shank, which is in turn less than but about the same as the initial diameter of the workpiece bore; further, the rivet first section is radially outwardly deformed in place to have peripheral engagement with the first counterbore to establish a seal therebetween. Also, the first counterbore is preferably radially deformed outwardly by the radial expansion of the rivet first section, and to an extent that the first counterbore remains circular in use, i.e. does not elongate relative to the head circular first section, in response to flexing, whereby corrosive fluids cannot enter between the head and work. For best results, the radially outward deformation of the first counterbore is between 0.0002 and 0.012 inches, in assembled condition.

Further, full reception of the slug into the work bore and counterbores, with clearance at the bore and first counterbore prior to deformation, as will be described, enables ready and full radial expansion of the rivet against the work first counterbore and bore to form the work expanding head producing very high allowable shear strength and fatigue strength in the riveted joint. In addition, existing tooling may be employed to effect the method of riveting as described. Also the rivet may be axially impacted at either end, and bucked at the opposite end, to expand the rivet slug and form the upset in the manner to be described, the fastener thereby being made fluid tight at both ends. Any excess material at the head end may be removed as by milling or shaving.

Another important advantage resides in the fact that the head height or axial dimension may be reduced or decreased to enable use of the fastener with thinner skins, the upper bearing area in the first counterbore enabling this result.

These and other objects and advantages of the invention, as well as the details of an illustrative embodiment, will be more fully understood in the following specification relating to the drawings in which:

DRAWING DESCRIPTION

Figure 3:
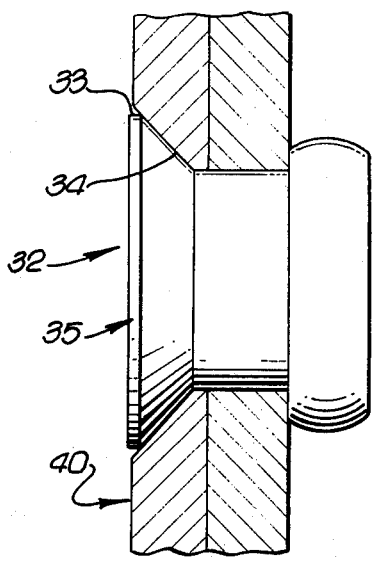
FIG. 3. PRIOR ART
Figure 2:
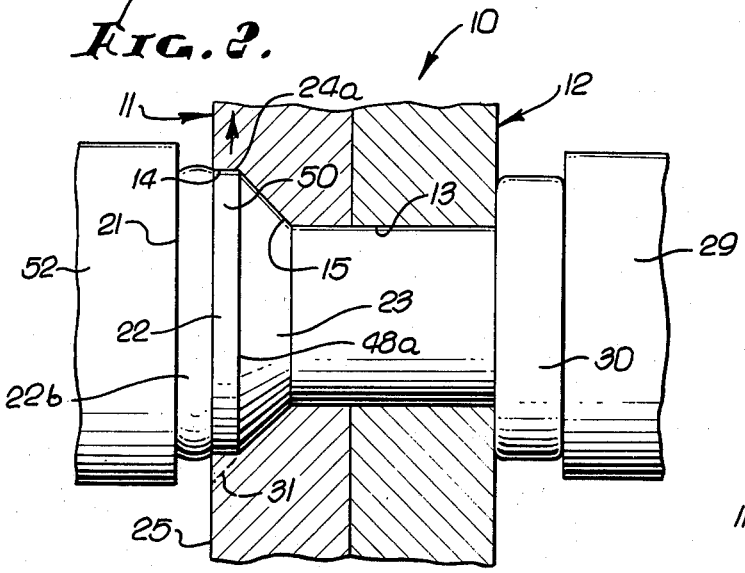
FIG. 2 is a view like FIG. 1 but immediately following rivet deformation.
Figure 2A:
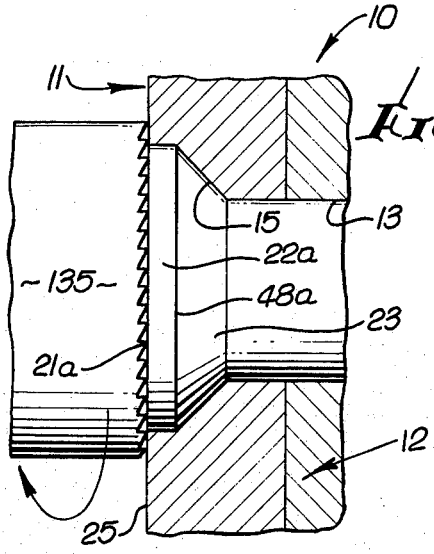
Figure 4:
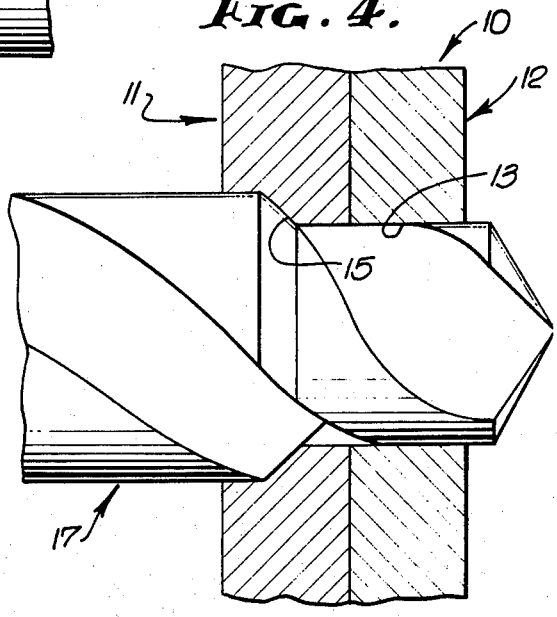

FIG. 2*a* is a view like FIG. 2, showing removal of excess rivet head material;

FIG. 3 is an elevation, taken in section, showing a conventional rivet after completion of deformation;

FIG. 4 is an elevation, taken in section, showing a tool initially forming the bore, counterbore and countersink in the workpiece; and FIGS. 5–7 and 8–10 are sections showing stages in deformation of modified rivets.

DETAILED DESCRIPTION

Figure 1:
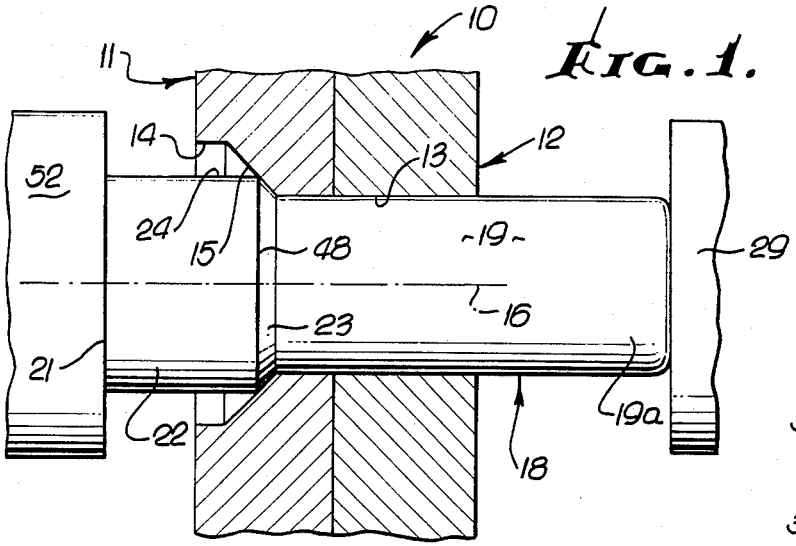
FIG. 1 is an elevation, taken in section, showing a rivet inserted into a workpiece, and just prior to rivet deformation.

In FIGS. 1 and 2, the workpiece 10 includes, for example, two metallic panels 11 and 12. The latter contain a main bore 13 extending in both panels, a first substantially cylindrical counterbore 14 and a second frusto-conical counterbore 15 in panel 11. The second counterbore 15 forms a countersink, as shown, extending between counterbore 14 and bore 13; also the bore 13, and counterbores 14 and 15 have a common forwardly extending axis 16. FIG. 4 shows a rotary combination drill 17 forming the bore and counterbores.

FIG. 1 also shows a metallic rivet slug 18 having an axially extending cylindrical shank 19 received or inserted forwardly in and through bore 13, the rivet slug tail end **19*a* projecting forwardly of panel 12 typically to an extent between 1 and 1.5 the diameter of shank 19**.

The rivet slug also includes rearward end face 21 which may be initially flat as seen in FIG. 1 (or slightly domed), a first section 22 located forwardly of end face 21, and a second forwardly tapered section 23 located forwardly of the first section and radially inwardly of counterbore 15. Tapered section or shoulder 23 seats against counterbore 15 and limits rivet insertion to provide the 1 to 1.5 dimension referred to.

The first section 22 has, in FIG. 1, an initially undeformed outer surface 24 diameter which is typically slightly greater than the diameter of shank 19; however, as shown in FIG. 2, the rivet first section 22 becomes radially deformed or expanded outwardly as at 24*a* into tight peripheral engagement with the first counterbore 14, thereby providing such a tight seal therewith as to prevent ingress of corrosive fluid from the exterior during normal flexing of the work. In this regard, the counterbore 14 is preferably permanently expanded radially outwardly by the rivet first section periphery, and between 0.0002 and 0.012 inches in assembled condition, for best results. Note also that the expanded head sections 22 and 23 completely fill the second counterbore 15, in FIG. 2, intersection 48 in FIG. 1 moving to 48*a* in FIG. 2. Further, the rivet metal may have a tensile strength of at least about 14,000 psi and higher, and the work a tensile strength substantially greater or lesser than the rivet tensile strength. The rivet and work may each consist of like material such as aluminum, aluminum alloy, titanium or titanium alloy, for example. Thus, the head and work will expand and contract at the same rate to prevent formation of radial gaps during temperature change.

In FIG. 2*a,* the axial length of the land 22*a* between the head resultant end face 21*a* and intersection 48*a* is typically between about 0.008 and 0.140 inch.

Also, in FIG. 2 both the expanded counterbore 14 and the rivet first section expanded outer surface 24*a* preferably are substantially cylindrical, but may have forward frusto-conical taper angularity between 0° and about 10° relative to axis 16. The total thickness of panels 11 and 12 is typically between 0.032 and 0.750 inches. The invention permits the use of thinner fuselage skins than are presently allowable using conventional rivets, in view of the increased shear strength afforded by the connection; this in turn permits substantial weight savings, in aircraft. Also, in retrofitting aircraft skins, the existing countersink 34 need not be deepened since the head of the fastener does not require additional depth, which eliminates need for new skins and the very substantial cost of same.

It will be noted from FIG. 2 that the head end face 21 projects slightly from the work face 25. FIG. 2*a* shows the use of a tool such as end mill cutter 135 operable to remove the excess rivet head material 22*b* and thereby produce a flush relationship between the rivet head end face 21*a* and the work surface at 25. An anvil 29 is urged against the tail 19*a* to form the upset 30 (see in FIG. 2) during force transmission to the head. Such deformation may be carried out by automatic tooling, as for example so-called "DRIVEMATIC" equipment 52. Formation of the upset occurs simultaneously with filling of the counterbores 14 and 15 and expansion of counterbore 14.

Work countersink 15 shoulders the tapered section 23, during impacting, to stop forward travel and control the length of the rivet in the work. The shank 19 also undergoes radial expansion, typically to expand the bore 13 up to about 0.016 inches radially.

The method of securing the rivet in FIG. 2 position may be considered to include the following steps:

a. inserting the slug to extend within the bore and counterbores, and b. deforming the slug axially and radially to fill the bore and counterbores and to expand the first counterbore.

Further, slug deformation may be continued until the first counterbore 14 is permanently radially outwardly deformed thereby to form a peripheral seal which will not be broken during normal strain deformation of the work; and the head end of the rivet may be made substantially flush with the work side 25. Paint subsequently applied over the end face 21*a* and workside 25 will not then form a ring, or crack during flexing of the work, high fatigue strength of the work will be achieved, high shear strength of the rivet head will be maintained, and the joint between the head and work will be fluid tight.

In addition, the rivets may be placed more closely together, since excess tapered hole extent (indicated by broken line 31 in FIG. 2) is eliminated, reducing hole size. FIG. 3 shows a prior art rivet 32 with a pre-formed fully tapered head 35 forming a peripheral corrosion gap 33 at the edge of the hole 34. When paint is applied, it enters the gap and forms an objectionable visible ring; also it cracks when flexed, and allows corrosive fluid to enter the gap.

The invention enables the use of thinner aircraft fuselage skins, as previously explained; conventional tooling may be employed to deform the rivet; the rivet is easy to drill out if required; warpage of the work due to riveting is reduced; and the formation of the seal between the work and rivet head eliminates openings therebetween during flexing of the work, so that ingress of corrosive fluid is prevented, and so that a visible "ring" does not form around the head when painted. All of these advantages are obtained at essentially no increase in cost over standard rivets.

Figure 5:
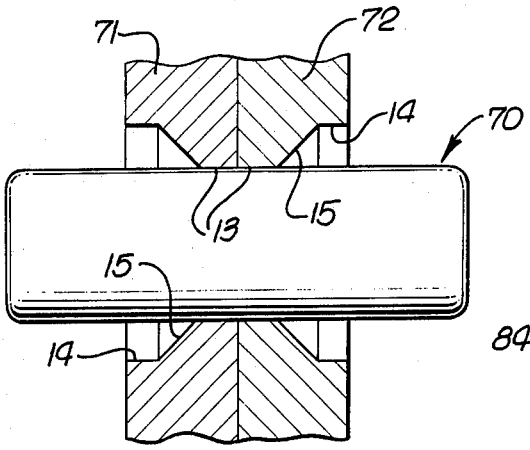
Figure 6:
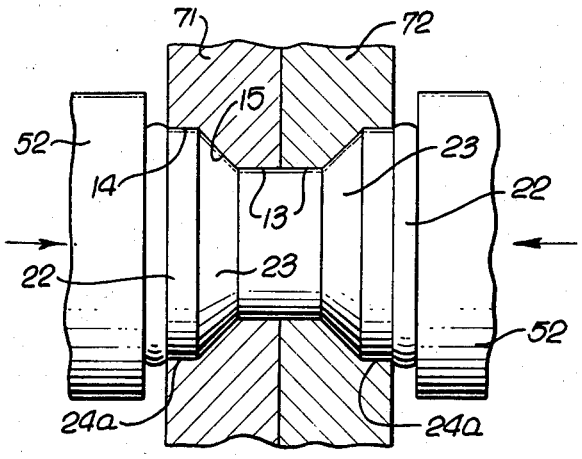
Figure 7:
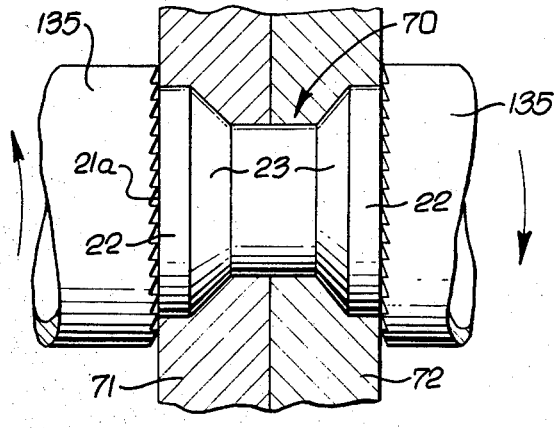

FIGS. 5–7 show the steps involved in securing a constant diameter rivet slug 70 to metallic sheets 71 and 72. The slug has constant initial diameter, and is symmetrically deformed at its opposite ends, both axially and radially, to form heads, fill the bores 13 and like counterbores 14 and 15 in each sheet, and to expand the first counterbore 14 in each sheet, all in the same manner as discussed above for rivet 18. Excess rivet head material is removed as by rotary end mill cutters 135, in FIG. 7, to form flush heads at 21*a.*

Figure 8:
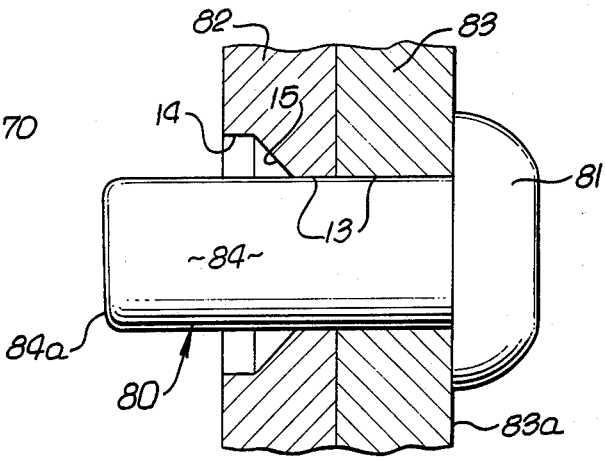
Figure 9:
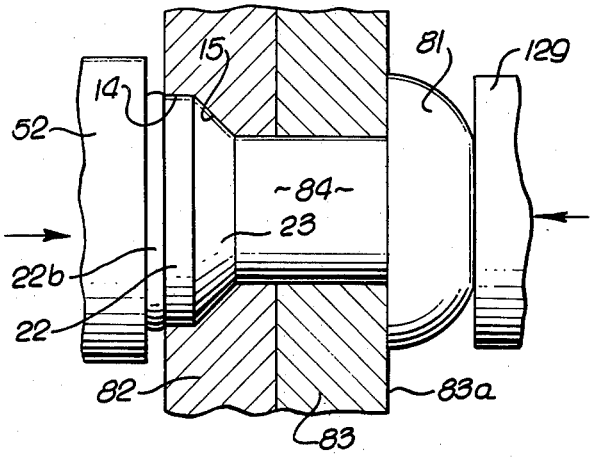
Figure 10:
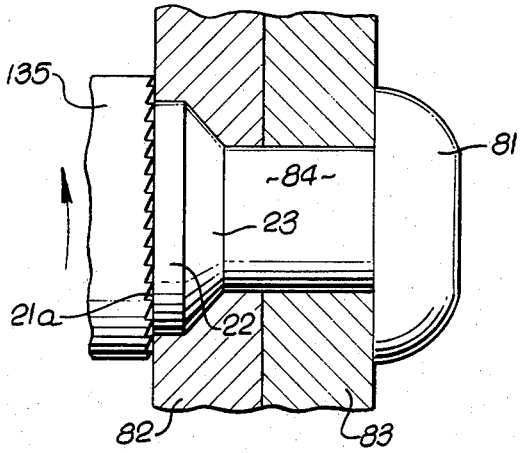

FIGS. 8–10 show the steps involved in securing a rivet 80 having a button head 81 to work sheets 82 and 83. The uniform diameter rivet shank 84 is inserted through bores 13 in work sheets, as shown, until head 81 engages the outer surface 83*a* of sheet 83. Thereafter, the rivet shank tail 84*a* is deformed, both axially and radially in the manner and by means 52 is discussed above, for expanding the first counterbore 14 in sheet 82. Back-up force may be applied by means 129 to the button head 81 during deformation of the tail 84*a.* Tool 135 is employed to remove excess material 22*b* in order to form a flush head at 21*a,* in FIG. 10.

The additional lap joint shear strength obtained by the invention is the result of the cold work in the head or heads and the interference at the periphery of the head or heads, which holds the fastener in alignment giving a higher yield strength in shear.

I claim:

1. In the method of securing a rivet slug to work containing a bore, a substantially cylindrical first counterbore that opens to one side of the work, and a second counterbore which is frusto-conical and tapers forwardly between the first counterbore and the bore, the steps that include, a. inserting the slug to extend within the bore and counterbores, and b. deforming the slug axially and radially to fill the bore and counterbores and to permanently expand the first counterbore, said deformation being carried out to radially expand that portion of the slug within the first counterbore to substantially greater extent than that portion of the slug within said bore, c. the slug prior to said deformation having a shoulder axially facing the second counterbore, and said insertion step being carried out to locate said shoulder against the second counterbore, and to locate opposite ends of the slug projecting outwardly from opposite sides of the work, prior to said deformation.

2. The method of claim 1 wherein the deformation step is carried out to expand the first counterbore radially by an amount between 0.0002 and 0.012 inches, in assembled condition.

3. The method of claim 1 wherein the slug deformation is carried out to also expand said bore.

4. The method of claim 1 including the step of removing any excess slug material at said one side of work to provide a rivet end surface flush with that side.

5. The method of claim 1 wherein slug deformation is carried out to axially contract the slug at opposite ends thereof, forming a head substantially completely contained within said counterbores, and an upset at the opposite end of the rivet.

6. The method of claim 1 wherein the slug consists essentially of aluminum.

7. The method of claim 4 wherein the deformation is carried out to produce a rivet cylindrical land radially inwardly of the first counterbore of a width between 0.008 and 0.140 inches.

8. The method of claim 1 wherein said deformation is carried out to expand the first counterbore to form an annular counterbore surface which extends forwardly at a frusto-conical taper angle of between 0° and 10° relative to an axis defined by said bore.

9. The method of claim 1 wherein said deformation is carried out to seat a radially expanded section of the slug fully against said tapered counterbore, and also to expand the workbore radially between 0.000 and 0.016 inches, in assembled condition.

10. The method of claim 1 wherein the work includes two sheets each containing a bore and counterbores as defined, and the slug is deformed at its opposite ends to fill said bores and counterbores in each sheet.

* * * * *